United States Patent [19]

Gowins

[11] 3,953,028

[45] Apr. 27, 1976

[54] TETHERED BALL BASEBALL BATTING PRACTICE DEVICE

[76] Inventor: Tim Gowins, 10034 Antrim, La Porte, Tex. 77571

[22] Filed: Apr. 5, 1974

[21] Appl. No.: 458,231

[52] U.S. Cl. ..... 273/26 EA; 273/58 C

[51] Int. Cl.[2] ..... A63B 69/40

[58] Field of Search ..... 273/26 E, 26 EA, 95 A, 273/95 AA, 200 A, 184 B, 185 C

[56] References Cited

UNITED STATES PATENTS

| | | | |
|---|---|---|---|
| 1,224,410 | 5/1917 | Porte | 273/200 A |
| 1,907,412 | 5/1933 | Zimmer | 273/200 A |
| 3,550,937 | 12/1970 | Wright | 273/26 EA |
| 3,558,134 | 1/1971 | Hoitsma | 273/26 EA |
| 3,703,286 | 11/1972 | Adkin | 273/26 EA |

FOREIGN PATENTS OR APPLICATIONS

| | | | |
|---|---|---|---|
| 876,557 | 11/1942 | France | 273/95 AA |

*Primary Examiner*—Richard C. Pinkham
*Assistant Examiner*—T. Brown

[57] ABSTRACT

A batting practice device having a pair of spaced apart, vertically extending support frame members. One of the support frame members is provided with a rebound board and the other support frame member is provided with a tension spring assembly. A guide wire is attached between the support frame members having one of its ends attached to the rebound board assembly and its other end being attached to the tension spring assembly. A bushing element is attached to the guide wire for sliding movement therealong. A tether line is attached to the bushing element for suspending a ball therefrom; a ball is attached to the tether line and suspended thereby at a height to be struck by a practicing batter and therefore propelled along the guide line to subsequently strike the rebound board. The tension spring assembly is in the form of a plurality of springs arranged in a square based truncated pyramid cage pattern. The rebound board and tension spring assembly are vertically adjustable on the support frame members.

6 Claims, 6 Drawing Figures

TETHERED BALL BASEBALL BATTING PRACTICE DEVICE

BACKGROUND OF THE INVENTION

The invention achieves tautness in cable movement while the ball is shortly tethered from the cable slide bushing, features not achieved by the earlier Coffee U.S. Pat. No. 1,554,409, in 1925; or by the Anson U.S. Pat. No. 2,772,882 in 1956. Nor is the cable elastic and stretchable substantially coextensive with ball travel as in the Denegree U.S. Pat. No. 3,042,401, 1962. Nor does the upper end of the cable have to be anchored to a necessarily locatable natural object, with ball return by gravity, as in Albert U.S. Pat. No. 3,086,776, 1963. Also only a single cable is required rather than upper and lower cables, as required by Lingbeck U.S. Pat. No. 3,630,521, 1971. Finally, the invention provides a decided improvement in degree of simulation of actual swinging against the force of a thrown baseball due; the live ball rebounding with force after striking any point of a backboard; such backboard, or ample rebound imparting area not being provided by even the latest Adkins U.S. Pat. No. 3,703,286, 1972.

The invention thus relates to a baseball batting practice device that simulates, (upon ball rebound from backboard, as tether slides back along a studiedly prepositioned cable), the arrival of a thrown baseball in confrontation with a batter, this similarity being attained by a particularly calculated combination of structures.

As a particular object, the invention sets out to provide a baseball batting practice device with all parts assembled with tautness, with batted ball of live, resilient material, tethered by a braided cord to a substantially weightless slide bushing which travels a cable between frames, to stop before a backboard of substantial area, which is struck by the ball which rebounds with substantial force to return to location again to be batted.

It is also an important object of the invention to provide a baseball batting practice device of this class which provides a coil spring cage, with springs in such tension as to yield to any slight deflection of the music wire or cable between frames, as such deflection tends to be caused by the slide bushing, braided cord, tethered ball being struck by a batter with an impact in direction other than directly toward the confronting backboard; upon ball rebound the coil springs restoring the music wire to normal straight axis extension.

It is yet another object of the invention to provide a baseball batting practice device of this class in which the ball, of live resilient material, is tethered by means of a braided, substantially non-stretchable cord to a substantially weightless slide bushing, lined to minimize sliding friction between the bushing and cable.

It is also a further object of the invention to provide a baseball practice device of this class with spring cage and backboard on similarly constructed frames or uprights provided to permit selective adjustment of spring cage and backboard in elevation, the same adjustments being permitted when spring cage assembly and backboard assembly are switched with relation to frames or uprights.

Other and further objects will be apparent when the invention is considered in connection with the drawings, with views to be briefly described immediately hereinbelow, and to be further described at length in the following details of the specification.

SUMMARY OF THE INVENTION

The invention is of a baseball batting practice device which permits the establishment of axis of live resilient ball suspension at adjustable, predetermined elevation, with struck ball to travel as directed, within limits, and with slightest friction along suspension cable axis to strike a backboard of ample area. The live ball rebounds to be returned by force of rebound, as slidable suspended, to original batter swinging position. Upon ball rebound a spring cage opposite the backboard supporting end of the device restores the music wire or cable between support frames, from deflected to a normally straight, predetermined travel axis.

DETAILED DESCRIPTION

Figure 1:
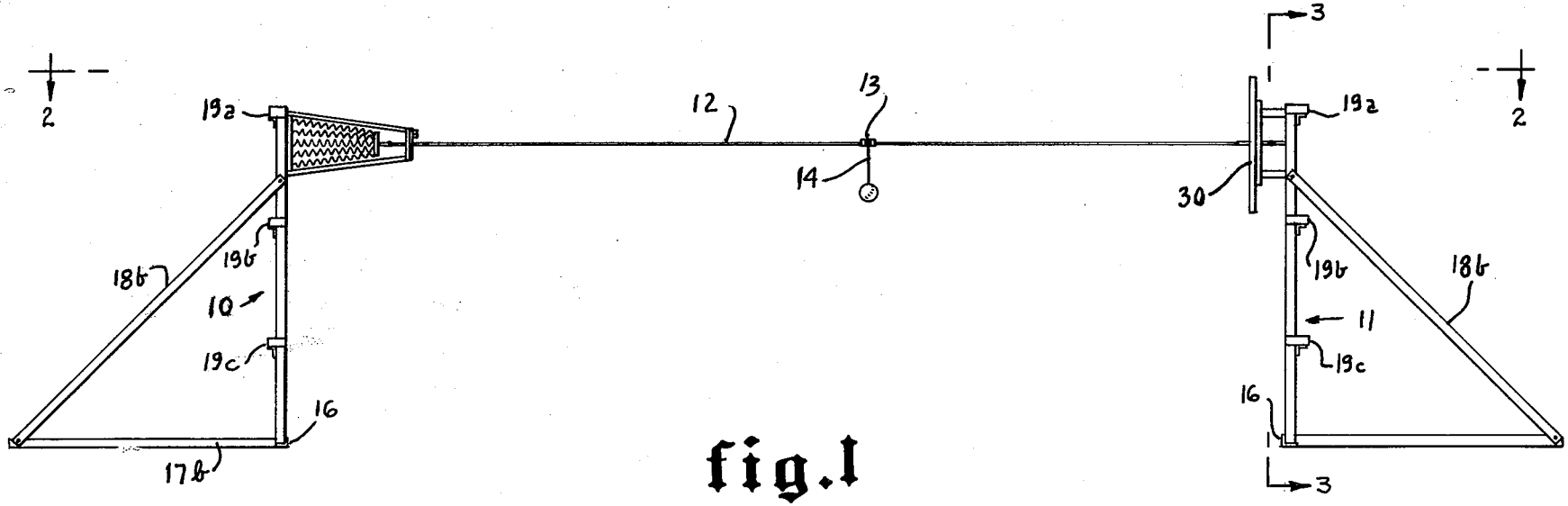
FIG. 1 is a side elevational view of an embodiment of a baseball practice apparatus.

Referring now to the drawings, in which like reference numerals are applied to like elements in the various views, a baseball batting practice device is shown in FIG. 1 with a spring cage frame or supporting upright 10, to the left, spaced from a backboard assembly frame or supporting upright 11 on the right. A cable or music wire 12 extends between the uprights 10 and 11 with a slide bushing 13 being indicated as slidable thereon, a suspension cord 14 carries the ball 15 suspended below the slide bushing, at elevation above ground or base level best to be struck by a practice batter.

Figure 2:
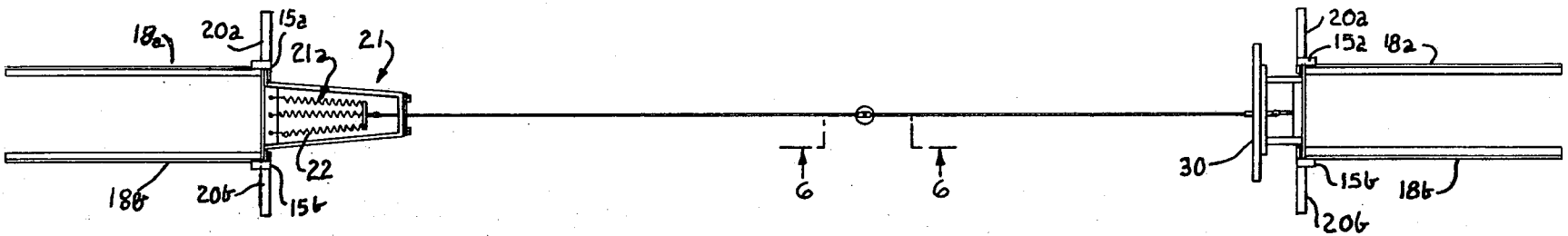
FIG. 2 is a plan view taken along line 2—2 of FIG. 1.
Figure 3:
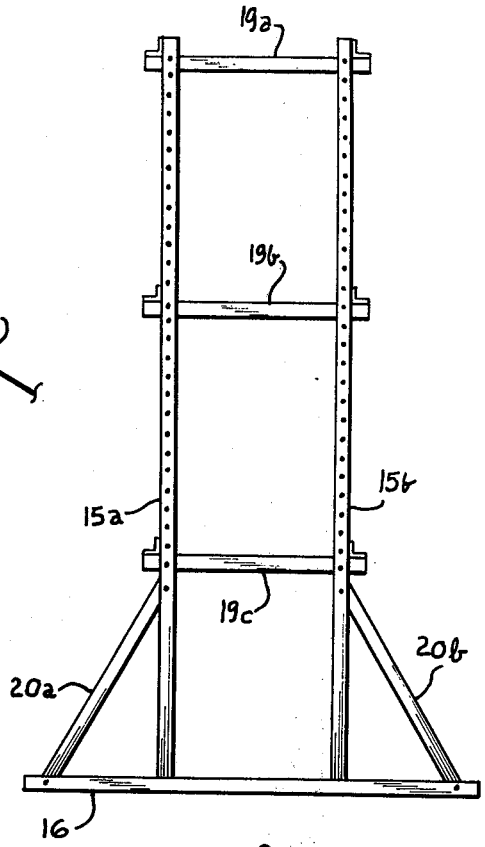
FIG. 3 is a transverse sectional elevational view, looking forwardly at the rebounding board of the apparatus.

As shown in FIGS. 1 and 2, each frame or upright 10, 11, includes, respectively left and right upright members 15*a*, 15*b*, above a transverse angle 16 at bottom, with left and right base runners 17*a*, 17*b*, extending rearward and forwardly respectively, and with left and right diagonals 18*a*, 18*b*, extending upwardly from the base runner outer ends to be connected upwardly to the respective upright members 15*a*, 15*b*. Upper, central and lower transverse members 19*a*, 19*b*, 19*c* extend between, and space apart, the upright members 15*a*, 15*b*, while these uprights are side braced by diagonal members 20*a*, 20*b*, best shown in FIG. 3, with lower ends connected outwardly to the transverse angle 16 near the outer ends thereof. As shown in FIG. 3, the uprights have equally spaced apart and cross aligned bolt holes therethrough for adjustably disposing spring cage or backboard assembly, (to be described later), at selective, predetermined elevations.

Figure 4:
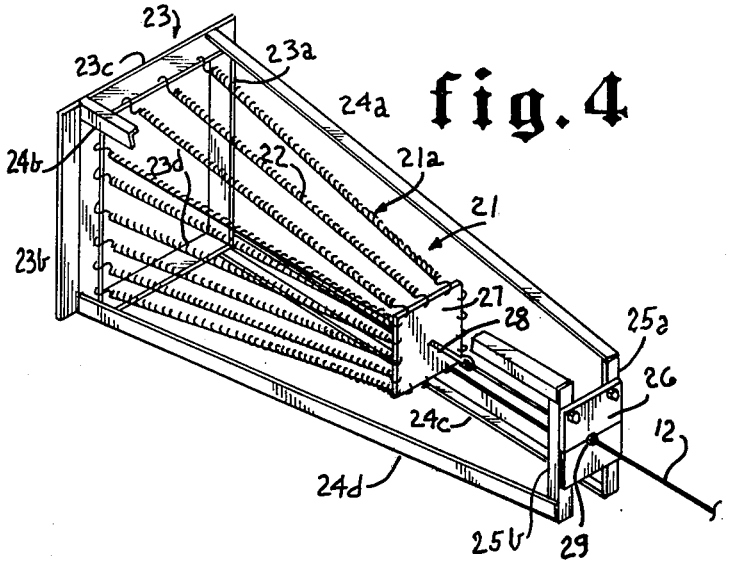
FIG. 4 is a fragmentary isometric view showing the operation of the tension spring assembly and ball carrier wire.

If FIGS. 1, 2 and 3 are now considered with relation to FIG. 4, the construction and operation of the spring cage assembly 21 may best be understood. As hereinabove stated, the spring cage or spring cage assembly, through its tensioned coil springs 22, restores the cable or music wire 12 to a straight axis, if deflected by the blow of a bat striking the ball other than straight forwardly.

The cage assembly 21 comprises rearwardly a rectangular structure 23, including left and right, vertically disposed angles 23*a*, 23*b*, connected by upper and lower cross members 23*c*, 23*d*. From the angle corners smaller frame angles 24*a*, 24*b*, 24*c*, 24*d* extend slightly diagonally forwardly to converge at the forward end of the spring cage assembly at tops and bottoms of left and right, vertically disposed angles 25*a*, 25*b*, which are shorter than the angles 23*a*, 23*b*. A cross plate structure 26 connects the angles 23*a*, 23*b*. Coil springs 22 normally in tension, have their rear ends connected, at substantially equally spaced apart locations, to the vertical angles 23*a*, 23*b*, and the cross members 23*c*, 23*d*. These springs 22 extend forwardly and connect at their forward ends around the top, sides and bottom of a vertically disposed, rectangular plate 27, of dimensions that its corners are spaced inwardly with clearance from the aforesaid frame angles 24*a*, 24*b*, 24*c* and 24*d*. An anchor bolt 28 is connected through the center of the connection plate 27, with the eyelet end of the anchor bolt 28 having the rear end of the cable or music wire 12 connected thereto. Thence the cable 12 extends forwardly through a guide hole 29 through the center of the cross plate structure 26, and further forwardly, as indicated in FIG. 4.

The coil springs 22, as symmetrically spaced by their forward and rear connections, in effect encage or delineate a space corresponding to a fallen truncated pyramid, with a horizontal, hypothetical axis through such space comprising a co-axial extension of the normally extending cable or music wire axis. This axis is normally constrained in the horizontal by its rearward connection to eyelet of anchor bolt 28 and passage through the guide hole 29 of the connection plate 26.

Figure 5:
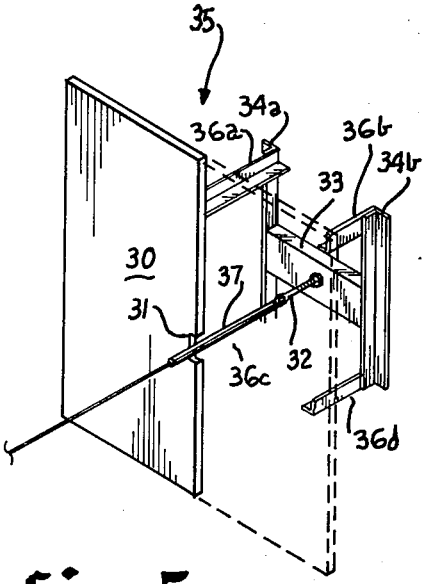
FIG. 5 is an isometric view of the rebounding board.

The music wire or cable 12 normally extends horizontally between frames or uprights 10 and 11, and forwardly, at the backboard 30, passes through a central slot 31, with longitudinal axis in the vertical, as best shown in FIG. 5. At its forward end the music wire or cable 12 is connected to the eyelet of a forward anchor bolt 32. The rearward threaded end of the anchor bolt 32 is firmly, adjustably fixed, as by nuts, and nuts acting as lock nuts, to a cross-member or channel 33 that extends centrally across between two upright angles 34*a*, 34*b*, that form the forward, or adjustably, elevationally connectable members of the backboard assembly 35, by which it is connected by bolts to the upright of the forward frame 11. See FIG. 3. Four rearwardly, horizontally extending angles 36*a*, 36*b*, 36*c*, 36*d* with forward ends connected upwardly and downwardly, respectively, to tops and bottoms of the upright angles 34*a*, 34*b*, are indicated in FIG. 5 as having their rearward ends, not shown, rigidly, firmly and strongly connected to the forward surface (back face) of the backboard 30, thus to cantilever this member to upstand vertically. The backboard contact area is symmetrically disposed with relation to the slot 31, while a stop sleeve 37, slid over the music wire 12 and through the slot 31, has its forward end stopped at, or affixed to, the eyelet at the rear of the forward anchor bolt 32, with the rearward end of the stop sleeve 36 terminating at a predetermined convenient position a short distance rearwardly, of the backboard. Thus, as the ball is batted, the slide bushing 13 is stopped by contact with the stop sleeve 37 at the end of its forward travel, and the ball 15, tethered by the cord 14, swings against the backboard 30.

Noticeably, the batter may swing at the ball in a directed blow calculated normally to knock an infield grounder, or a high fly, or a line drive in any direction, or in directed elevation to achieve a hit to left, center or right field, and correspondingly the ball 15 tends to move at first in the exact direction imparted by the directed blow. However this direction of movement, (unless the direction of advance for the ball is straight ahead and at its normally suspended elevation) will be opposed by the relatively taut, horizontally extended music wire or cable 12, from rearward to forward anchor bolt eyelets 28, 32. The cable or music wire 12 at first tends to yield, at least in part, to the force and direction of the blow exerted on the ball, and responsive to this deflection, the axis of the spring cage 21a shifts slightly responsively. As the guide hole 29 is a bit over-sized with relation to the diameter of the cable or music wire 12, the rearward part of the cable 12 may shift correspondingly, responsive to the blow and its force and direction applied to the ball 15.

But still the ball 15 is tethered to the slide bushing 13 by the braided cord 14, and the length thereof, so the ball 15 can only straighten the cord 14 to extend substantially in direction of the blow, while after achieving this status, the ball 15 and cord 14 then tend to travel along with the sliding of the slide bushing 13 toward the forward end of the wire 12 which has responded less and less to deflection successively forwardly.

As the slide bushing 13 arrives at the end of forward travel and is brought to a stop by contact with the stop sleeve 37, the ball 15 still travels on still from result of bat impact. Now the arc of travel starts from the stopped slide bushing 13 as center, and with cord length as radius, swings the ball 15 into contact with the backboard 30, at some point of contact lower than the elevation the ball 15 first achieved when struck by the bat.

The force with which the ball 15 rebounds, (if the ball has been struck with any effective degree of force), is ample to start the slide bushing 13 rearwardly, to carry the tethered ball 15 back to batting area location.

Figure 6:
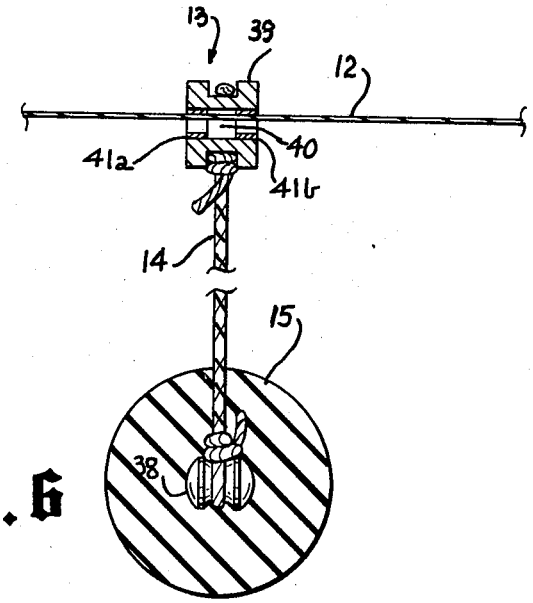
FIG. 6 is an enlarged cross-sectional, elevational view showing details of ball anchorage and slide carrier details.

Noticeably, as shown in FIG. 6, the ball 15 is of latex or of similar material, as of a live but wear resistant rubber. The cord 14 may be of a stout fiber, plaited to prevent unraveling, as would occur in the case of entwined strings or filaments. Its inner end is tied to, or knotted around a light, durable spool member 38, which is disposed centrally in the ball 15, the ball being molded. From the spool 38 the cord outer part is a radial line molded into the ball 15. Thence the plaited cord extends to the slide bushing exterior, also of spool shape 39, as shown in FIG. 6. The slide bushing 13 should be substantially weightless, or as light as possible, and designed to slide upon the music wire 12 with minimum friction. Thus the exterior part or spool 38 may best be of aluminum, with the bore 40 bushed at either end with light, but highly wearable bronze, or brass 41*a*, 41*b*.

The backboard 30 may be mounted at a relatively higher elevation, at a relative lower elevation, or at the elevation shown in FIG. 1, with relation to the spring cage assembly 21. In the first case the ball 15, upon rebound, would approach the batter at a slightly downward travel; in the second case the ball approach would be at a slightly upwardly travel; and in the third case the ball approach would be substantially horizontally. Also, although not shown in FIG. 2, positions of the batters plate may be imagined with forward right corner of plate slightly to the left and to the rear of the ball as shown, for right handed batters; and with forward left corner of the plate slightly to the right and to the rear of the ball as shown, for left handed batters. Obviously various plate positions and various relative backboard positions may be used in combination to simulate out of the ordinary batting conditions, as against pitchers with out of the ordinary styles of delivery.

The invention is not limited to the structural arrangements and combinations of elements shown in the drawings and described in the specification, but the broad spirit of the invention admits a wide range of structural arrangements and combinations of elements as falling within the range thereof. Also, the appended claims are by way of introduction and not by way of limitation.

I claim:

1. A baseball batting practice device comprising; a pair of spaced apart, substantially vertical support frames and an elongated high strength guide wire, horizontally extending and being supported at a desired height at each extremity by one of said support frames, said support frames being anchored to a suitable base; a slide-bushing captive to and slidable along said guide wire, and a tether line having one of its ends attached to said slide-bushing and a ball attached to its other end, said tether line and ball being movable along said guide wire with said slide-bushing, said guide wire having means to fixedly secure its extremities to said support frame, one of said support frames has a rebound board assembly and the other support frame has a wire tensioning assembly, one of said guide wire extremities being attached to said rebound board assembly and the other extremity being attached to said tensioning assembly; said tensioning assembly includes a vertically positioned substantially square frame having substantially equal length angle irons, each angle iron having first and second legs, the angle irons being connected together at their ends, two of said angle irons are vertically standing spaced apart and parallel and two of said angle irons are in a horizontal position spaced apart and parallel; the first leg of each angle iron projects outwardly of said frame, all first legs being positioned in a common vertical plane, the second leg of each angle iron being positioned substantially perpendicular to each first leg in said common vertical plane, said second leg of each said angle irons being provided with a plurality of spaced apart apertures and having a plurality of hooks inserted therein, each hook being for anchoring one end of a strand of resilient material thereto; a substantial distance from said vertical plane of said vertically positioned substantially square frame are two spaced apart, vertically positioned angle irons of lesser length than the angle irons of said square frame, said two angle irons being in a plane parallel to the plane of said square frame; extending from each corner of said square is an angle iron, one end of each last mentioned angle iron being attached to a corner of said square frame, and the other end of said last mentioned angle iron being attached to an end of one of said two angle irons to form a spring cage assembly; connecting said two angle irons of lesser length is a first plate comprising two plates of equal dimension and positioned above and below each other and coplanar in a substantially vertical plane, centrally located in said first plate is an aperture, a second plate; said second plate being substantially square, having a plurality of spaced apart apertures along its peripheral edge and being positioned in a substantially vertical plane intermediate said first plate and said square frame, the other end of each of said strands of resilient material being attached to said second plate at an aperture; an end of said guide wire inserted through said aperture in said first plate and being attached to said plate at the control point thereof; said first outwardly projecting legs of said angle iron of said square frame being means for anchoring said tensioning assembly to a vertical support frame.

2. The baseball batting practice device of claim 1 wherein said rebound assembly includes a support frame, said support frame being comprised of a pair of spaced apart, vertically positioned, parallel angle irons, said pair of angle irons being connected by an elongated, horizontally extending channel member, each end of said channel member being connected intermediate the ends of one of said pair of said rebound board support frame angle irons such that one leg of each angle iron extends outwardly and parallel from said channel member and the other leg of each said angle iron is perpendicular and connected to said channel member; to each extremity of said spaced apart, vertically positioned, parallel angle irons, one end of an elongated angle iron is attached thereto, said elongated angle iron extending substantially horizontally therefrom, the other end of each elongated angle iron being attached to a substantially vertically standing frame, said substantially vertically standing frame being attached to a substantially vertically standing rebound board, said rebound board being provided with a centrally positioned aperture and said channel member having a connecting means located intermediate its ends; said one end of said guide wire extending through said aperture in said rebound board and anchored by said connecting means to said channel member, said guide wire extending at an angle of substantially 90 degrees from said rebound board; said outwardly extending legs of said pair of angle irons being means for anchoring said rebound assembly to a vertical support frame.

3. The baseball batting practice device of claim 1 wherein said ball is fixedly attached to said tether line; means for fixedly attaching said ball to said tether line, said fixedly attaching means includes means a substantially spherical shaped object imbedded in said ball said other end of said tether line extending through the outer surface of ball and being anchored to said object

4. The baseball batting practice device of claim 1 wherein said slide bushing is a length of tubular material having intermediate its ends and encircling its outer surface a shallow groove for fixedly securing said one end of said tether line thereto, and a transverse bore extending longitudinally therethrough, said bore having at least one tubular bushing inserted therein for slidably engaging said guide-wire when said slide-bushing is propelled along said guide-wire.

5. The baseball batting practice device of claim 1 wherein said pair of support frames are identical, each support frame being secured in a vertical position by diagonal bracings extending outwardly and downwardly from said support frame and having their lower ends secured to said base, each of said support frame comprising a pair of elongated, parallel, spaced apart and vertically extending angle irons, the lower ends of said support frame angle irons being fixedly anchore to said base and are connected intermediate their ends by at least one horizontally extending bar; one leg of each support frame angle iron is projecting inwardly of said frame and the other leg of each support frame angle iron is connected to the upper end of said bracing, said inwardly projecting legs of said support frame angle irons being adapted to interlock with said first outwardly projecting legs of said angle iron of said square frame of said tensioning assembly and said outwardly projecting legs of said pair of angle irons of said rebound assembly.

6. The baseball batting practice device of claim 5 wherein means is provided for vertical adjustment of said tensioning assembly and said rebound assembly on said support frames, said vertical adjustment means comprising a plurality of equally spaced vertically aligned adjustment apertures in said inwardly projecting leg of each angle iron of said pair of elongated, parallel, spaced apart, vertically extending angle irons and at least one adjustment aperture in each said first outwardly projecting leg of said angle iron of said square frame of said tensioning assembly and at least one adjustment aperture in each outwardly projecting leg of said pair of angle irons of said rebound assembly, said vertical adjustment being accomplished by aligning a pair of adjustment apertures of said tensioning assembly and said rebound assembly with a pair of adjustment apertures in said support frame and inserting a bolt or peg in each pair of aligned apertures.

* * * * *